US007028785B2

(12) United States Patent
Randa

(10) Patent No.: US 7,028,785 B2
(45) Date of Patent: Apr. 18, 2006

(54) PNEUMATIC IMPACT PIERCING TOOL

(75) Inventor: Mark D. Randa, Summit, WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 11/194,232

(22) Filed: Aug. 1, 2005

(65) Prior Publication Data

US 2005/0257941 A1 Nov. 24, 2005

Related U.S. Application Data

(63) Continuation of application No. 10/824,910, filed on Apr. 15, 2004, now Pat. No. 6,923,270.

(51) Int. Cl.
*E21B 4/14* (2006.01)

(52) U.S. Cl. ..... 173/91; 175/19; 175/296

(58) Field of Classification Search ..... 173/15, 173/17, 90, 91, 206, 211, 135; 175/19, 296
See application file for complete search history.

(56) References Cited

U.S. PATENT DOCUMENTS

| | | | | |
|---|---|---|---|---|
| 3,407,884 A | | 10/1968 | Zygmunt et al. | 173/91 |
| 4,144,941 A | | 3/1979 | Ritter | 175/19 |
| 4,194,435 A | | 3/1980 | Gaun et al. | 91/234 |
| 4,221,157 A | * | 9/1980 | Schmidt | 91/416 |
| 4,834,193 A | | 5/1989 | Leitko, Jr. et al. | 175/19 |
| 4,872,516 A | | 10/1989 | MacFarlane et al. | 173/134 |
| 5,025,868 A | | 6/1991 | Wentworth et al. | 173/91 |
| 5,311,950 A | * | 5/1994 | Spektor | 175/19 |
| 5,318,135 A | | 6/1994 | Kayes | 175/19 |
| 5,337,837 A | * | 8/1994 | Wentworth et al. | 175/19 |
| 5,511,626 A | * | 4/1996 | Steen | 175/19 |
| 5,603,383 A | | 2/1997 | Wentworth et al. | 173/91 |
| 5,944,117 A | * | 8/1999 | Burkholder et al. | 173/91 |
| 5,954,145 A | * | 9/1999 | Hesse et al. | 175/19 |
| 6,047,778 A | * | 4/2000 | Coffman et al. | 173/91 |
| 6,273,201 B1 | * | 8/2001 | Randa et al. | 175/19 |
| 6,467,554 B1 | * | 10/2002 | Millican | 173/91 |

FOREIGN PATENT DOCUMENTS

| | | |
|---|---|---|
| DE | 800725 | 6/1956 |
| DE | 1 294 891 | 5/1969 |
| DE | 2 033 694 | 3/1974 |

* cited by examiner

*Primary Examiner*—Scott A. Smith
(74) *Attorney, Agent, or Firm*—Philips G. Meyers

(57) ABSTRACT

A pneumatic ground piercing tool includes a tail assembly including a tail nut and tail cap, the tail cap having a plurality of discharge ports for exhausting spent compressed air, the discharge ports opening into an annular space between a rearwardly opening recess of the tail cap and an air supply conduit such that the exhaust ports are shielded by a side wall of end cap from plugging when the ground piecing tool is operated in reverse mode.

17 Claims, 5 Drawing Sheets

PNEUMATIC IMPACT PIERCING TOOL

RELATED APPLICATION

This application is a continuation of U.S. application Ser. No. 10/824,910 filed Apr. 15, 2004, U.S. Pat. No. 6,923,270 issued Aug. 2, 2005 to Randa.

TECHNICAL FIELD

The invention relates to pneumatic ground piercing tools, and in particular to a ground piercing tool having an improved tail assembly and spent air exhaust configuration.

BACKGROUND OF THE INVENTION

Self-propelled pneumatic tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearward, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. These tools have been made reversible by providing a threaded connection between the air inlet sleeve and the surrounding structure which holds the air inlet concentric with the tool body. The threaded connection allows the operator to rotate the air supply hose and thereby displace the stepped air inlet rearward relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole.

U.S. Pat. No. 5,603,383, issued Feb. 18, 1997 to Wentworth et al., the contents of which are incorporated herein by reference, discloses a pneumatic ground piercing tool with an improved reversing mechanism provided as part of the air distributing mechanism. U.S. Pat. No. 5,025,868 issued Jun. 25, 1991 to Wentworth et al., the contents of which are incorporated herein by reference, describes a ground-piercing tool having an improved tail assembly including a nut and a tail cap which can be secured together by a series of conventional bolts which extend into threaded holes in the nut, clamping the nut with far less torque than would otherwise be required with a conventional, unitary tailpiece.

Spent compressed air used in conventional reversible pneumatic ground piercing tools is exhausted through one or more passages that typically open at the rear or sides of the tool. A problem encountered with this arrangement of the exhaust openings is that dirt and debris tend to accumulate in the openings, especially when the tool is operated in the reverse direction. Dirt and debris in the exhaust openings increases the back pressure against which the spent air must be discharged, impeding the flow of spent air through the openings and hindering the performance of the tool.

SUMMARY OF THE INVENTION

A reversible, pneumatic ground piercing tool includes an elongated hollow body having a front nose and a rear opening with a striker disposed for reciprocation within an internal chamber of the body to impart impacts thereto for driving the body through the ground. The tool includes a mechanism that reverses the direction of travel of the tool by causing the striker to impact against the tail assembly instead of the front end wall of the internal chamber of the body. The striker has a rearwardly opening recess and a rear radial passage through a wall enclosing the recess, and a front portion having a front bearing thereon for sliding contact with a first inner surface of the body. The striker includes passages permitting flow of pressure fluid to a front, variable-volume pressure chamber ahead of the striker and a rear portion having a rear bearing thereon rearwardly of the radial passage for sliding contact with a second inner surface the body.

A stepped air inlet conduit cooperates with the striker within the internal chamber of the body to reciprocate the striker and impart blows to a front end wall of the internal chamber under the action of a pressure fluid fed into the rear recess in the striker, followed by reverse movement of the striker when the rear radial passage moves past a front edge of the step of the stepped air inlet conduit. Spent compressed air is exhausted when the rear radial passage moves past a rear edge of the step of the stepped air inlet conduit.

A tail assembly mounted in the rear opening of the body secures the air inlet conduit in the body and includes a plurality of exhaust passage for exhausting spent air, at least a potion of each exhaust passage angling radially inwardly to communicate with a central hole at the rear end of the tail assembly such that exhaust air escapes through the central hole. In one variation, the angled portion of each exhaust passage extends at an angle of from 10 to 20 degrees relative to a lengthwise axis of the tool.

In one aspect, the tail assembly comprises a tail nut and an end cap disposed to fit over the rear opening of the body. The tail nut is threadedly secured to the body inside the rear opening thereof and with a central opening through which the air inlet conduit extends and a plurality of threaded, rearwardly opening holes. The end cap includes openings therein in alignment with the threaded holes in the tail nut and forming the central hole through which the air inlet conduit passes. A plurality of bolts extend through the openings and are threadedly secured in the threaded holes in the tail nut so that the end cap is securely clamped to the tool body and an axial clamp load is applied to the tail nut. In this regard, the tail nut and end cap have the exhaust passages therethrough, at least a portion of each exhaust passage angling radially inwardly to communicate with the central hole in the end cap such that exhaust escapes through the central hole about the outside of air inlet conduit.

DETAILED DESCRIPTION

Figure 1:
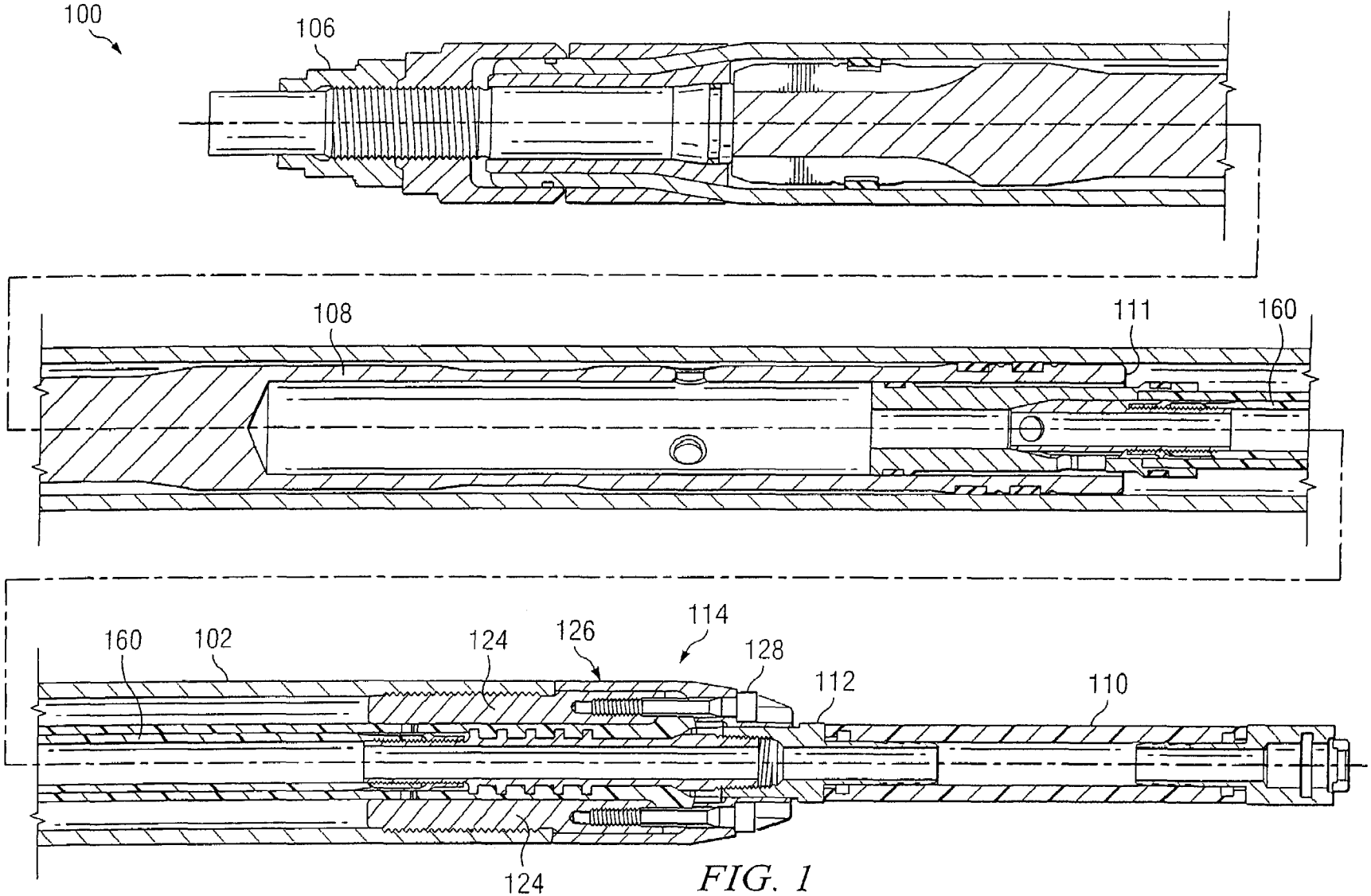
FIG. 1 is a partial cross section of a ground piercing tool in accordance with the invention taken through line A–A' of FIG. 3.
Figure 2:
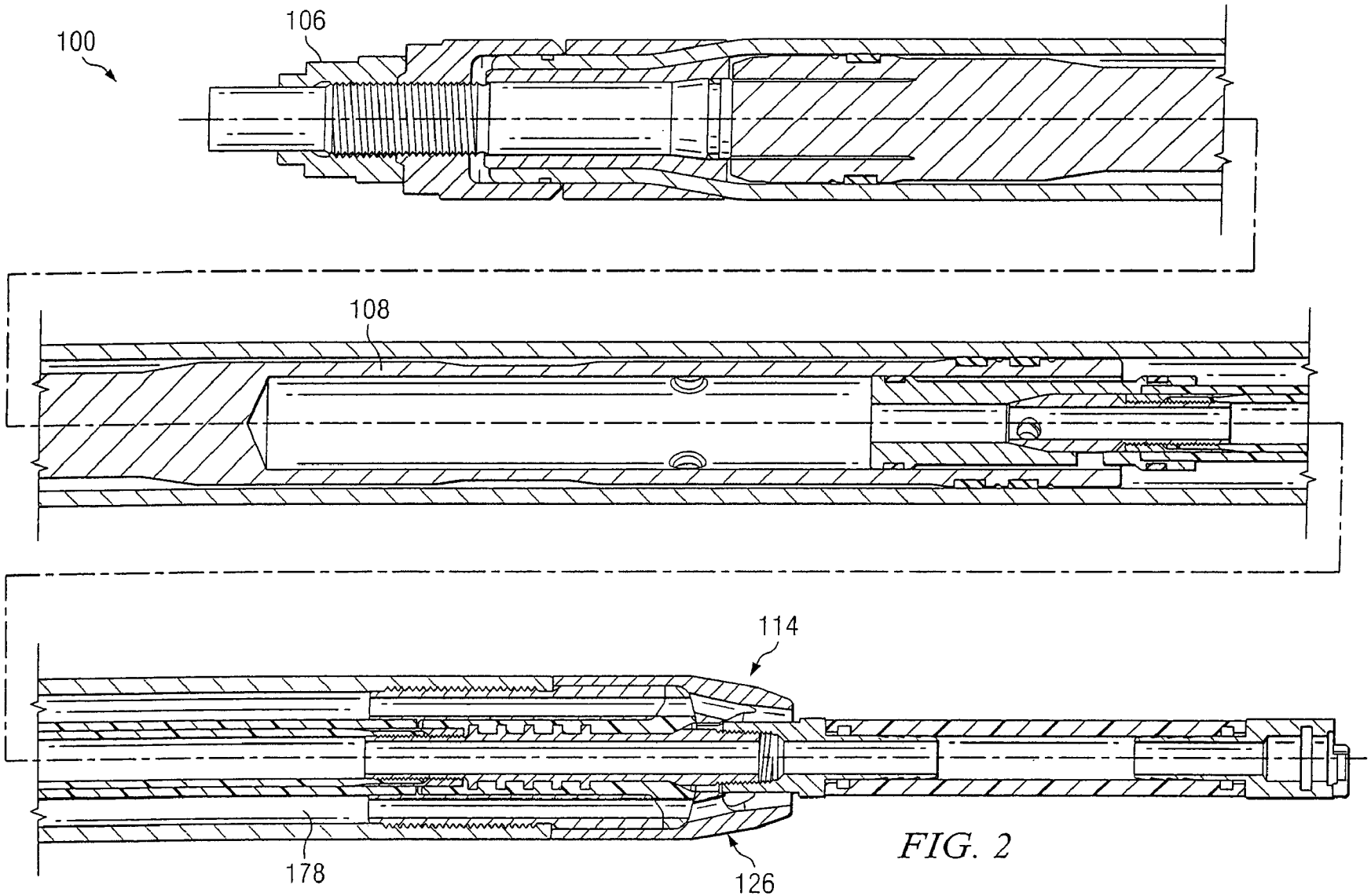
FIG. 2 is a second partial cross section of the ground piecing tool of FIG. 1, taken along line B–B' of FIG. 3.

Referring now to FIGS. 1 and 2, an elongated, pneumatically powered ground piercing tool 100 according to the invention includes a tool body 102 which includes a housing 104 and head assembly 106, and a striker assembly 108 for impacting against the interior of body 102 to drive the tool forward. Compressed air to power the tool is supplied via an air inlet conduit 110 including a threaded coupling 112 for attaching the conduit to tool 100. Conduit 110 may be a metal tube, a hose or a combination thereof. Conduit 110 cooperates with striker 108 to form an air distributing mechanism for reciprocating striker 108. A reversing mechanism, generally indicated at 111, such as disclosed in U.S. Pat. No. 5,603,383, allows the tool to be operated in a reverse mode. The reversing mechanism may have the type disclosed in U.S. Pat. No. 5,603,383 or otherwise known in the art.

Tool 100 further comprises a tail assembly 114 that encloses the rear end of housing 104 and secures air distributing mechanism and striker assembly 108 in the housing. Tail assembly 114 also provides means for exhausting spent compressed air from striker assembly 108. Tail assembly 114 includes a tail nut 124 and a tail cap 126 secured together by bolts 128. The forward most portion of tail nut 124 is provided with exterior threads 130 which engage a corresponding set of threads 132 on the interior of housing 104. The rearward portion of tail nut 124 includes an enlarged diameter portion or end flange 142 that fits in a counter bored section 144 of tail cap 126 which serves to clamp tail nut 124 in position.

Tail nut 124 includes a central hole 146 through which an inner tube 148 passes. Inner tube 148 includes a tapered rearmost end 150 that is provided with threads 152 that engage a corresponding set of threads 154 in coupling 112. The forward most end of inner tube 148 is provided with threads 156 for engaging corresponding threads 158 of an inner stepped sleeve 160. Inner tube 148 and sleeve 160 define a central passageway 161 for compressed air supplied via conduit 110 to operate striker assembly 108.

Figure 3:
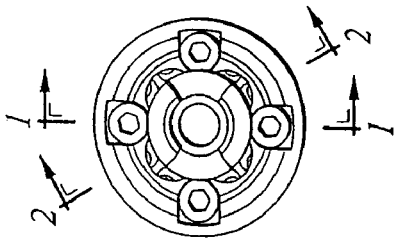
FIG. 3 is a rear view of the ground piercing tool of FIG. 1.
Figure 4:
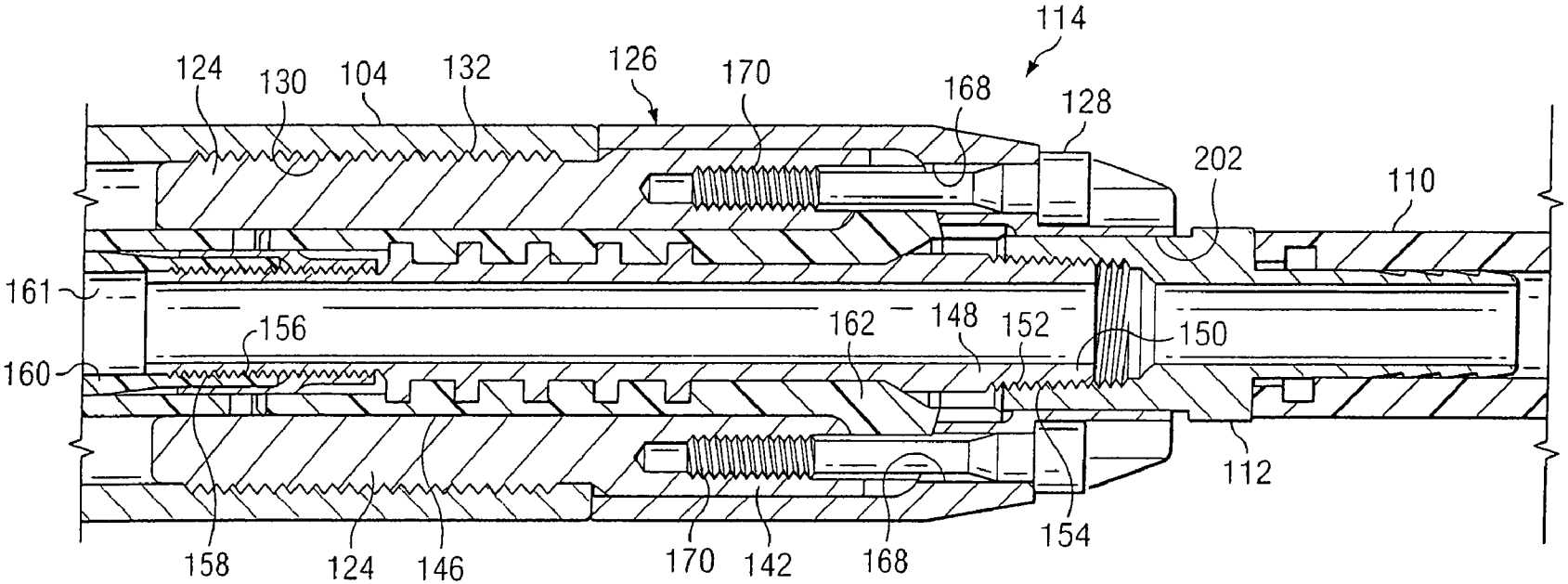
FIG. 4 is a second, enlarged partial cross section of the rearmost end of the ground piercing tool of FIG. 1 taken along line A–A' of FIG. 3.

A resilient, generally cylindrical isolator 162 is provided between inner tube 148 and tail nut 124. As illustrated in FIGS. 3 and 4, inner tube 148 is formed with a series of grooves 164 and lands 166 extending peripherally around the exterior of a middle section of tube 148. Isolator 162 may be formed by injecting a flowable plastic between tail nut 124 and inner tube 148 such that the plastic fills grooves 164, embedding lands 166 in the plastic and thereby securing inner tube 148 against lengthwise movement, although tube 148 remains free to rotate inside isolator 162.

As best illustrated in FIG. 4, tail cap 126 is secured in position with retaining assembly including a series of bolts 128 inserted through openings or bolt holes 168 in tail cap 126 and screwed into blind threaded holes 170 formed in the rearmost end of enlarged diameter portion 142 of tail nut 124. Opening 168 and blind holes 170 are formed in a circular pattern to maximize the clamping effect of bolts 128 while also maximizing the structural strength of tail cap 126 and tail nut 124, respectively.

In order to disassemble tail assembly 114, conduit 110 is first disconnected and bolts 128 are removed, after which tail cap 126 may be removed from housing 104. Tail nut 124 is then unscrewed from housing 104 whereby the air distribution system, reversing mechanism 111 and striker assembly 108 may be accessed for repair or replacement of parts. The configuration of tail nut 124, tail cap 126 and bolts 128 thereby facilitates rapid removal of tail assembly 114 for servicing and parts replacement while simultaneously providing a superior means of locking the assembly together during operation.

Turning now to FIGS. 5–9, compressed air used to reciprocate striker 108 is exhausted through an interior chamber 178 that communicates with a series of passages 180 extending through tail nut 124. Passages 180 are formed in a circular pattern around central hole 146 in tail nut 124 so as to maximize the cross sectional area of the passages, thereby reducing back pressure as spent compressed air is exhausted while maintaining the structural strength of tail nut 124. Passages 180 in turn communicate with exhaust ports 182 formed in tail cap 126 which are arranged in a circular pattern corresponding the arrangement of passages 180.

Figure 5:
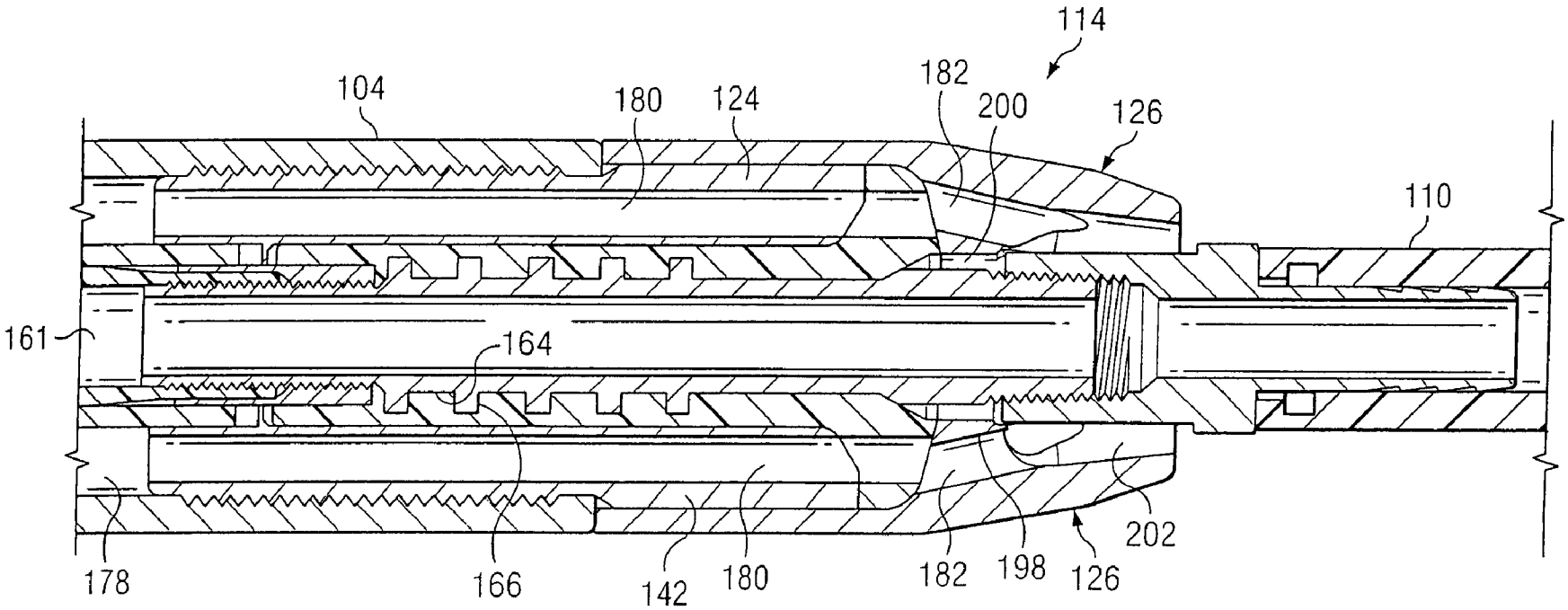
FIG. 5 is a second, enlarged partial cross section of the rearmost end of the ground piercing tool of FIG. 1 taken along line B–B' of FIG. 3.

As illustrated in FIGS. 6–9, tail cap 126 comprises a side wall 190 that forms a generally cylindrical forward section 191 having a forwardly opening cavity 192 and a tapered, generally conical end section 194 having a rearwardly opening recess 196. Forwardly opening cavity 192 ends at an internal partition 198 that includes a central opening 200 extending between rearwardly opening recess 196 and forwardly opening cavity 192. Central opening 200 is configured to receive the rearmost end of inner tube 148 (FIG. 4) such that conduit 110 may be inserted into rearwardly opening recess 196 and coupled to inner tube 148. As best shown in FIGS. 4 and 5, an annular space 202 is formed between inner wall 204 of rearwardly opening recess 196 and conduit 110 when the conduit is connected to inner tube 148.

Figure 7:
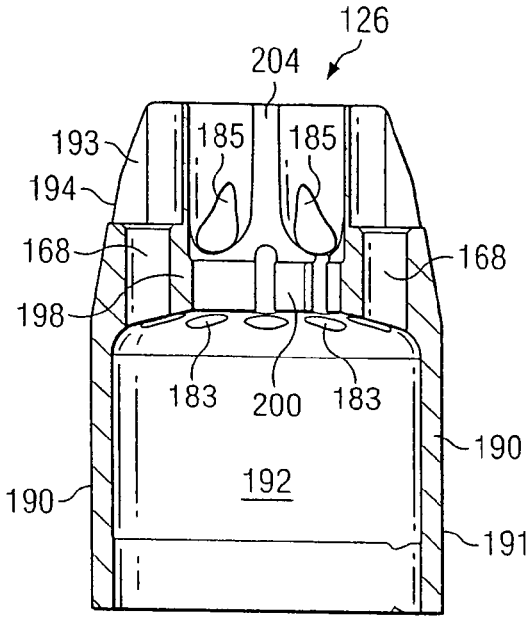
FIG. 7 is a partial cross section of the tail cap of FIG. 6 taken through line A–A' of FIG. 9.
Figure 8:
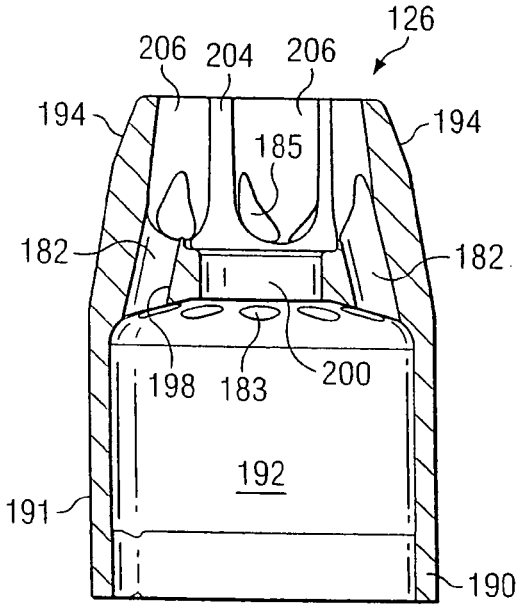
FIG. 8 is a second partial cross section of the tail cap of FIG. 6 taken through line B–B' of FIG. 9.

Forwardly opening cavity 192 is configured to receive the rear end 188 of tail nut 124 such that each of exhaust passages 180 is aligned with an exhaust port 182 for exhausting compressed air used to operate tool 100. Turning to FIGS. 7 and 8 each of exhaust ports 182 has a forward end 183 that communicates with an exhaust passage 180 and a rear opening 185 where compressed air is exhausted. Each of exhaust ports 182 is inwardly angled in a rearward direction such that ports 182 extend from cavity 192 through partition 198 and conical end section 194, opening into a semi cylindrical cutout 206 formed in the inner wall 204 of rearwardly opening recess 196 approximately midway along the length of conical end section 194. In one embodiment, each of exhaust ports 182 extends radially inwardly at an angle of from 10 to 20 degrees relative to a lengthwise axis of the tool. Semi cylindrical cut outs 206 serve to increase the cross sectional area of annular space 202 providing more area through which spent compressed air may be exhausted. Although as illustrated, exhaust ports 182 open into annular space 202 midway along the length of conical end section 194, the particular location may be forward or rear of the illustrated location so long exhaust ports 182 open into annular space 202 forward of the rearmost end of tail cap 126 whereby openings 185 shielded from debris by side wall 190 when tool 100 is operated in the reverse direction. As illustrated, conical end section 194 at least partially overlies the outlet holes but is spaced therefrom so as to shield openings 185 from debris.

Figure 9:
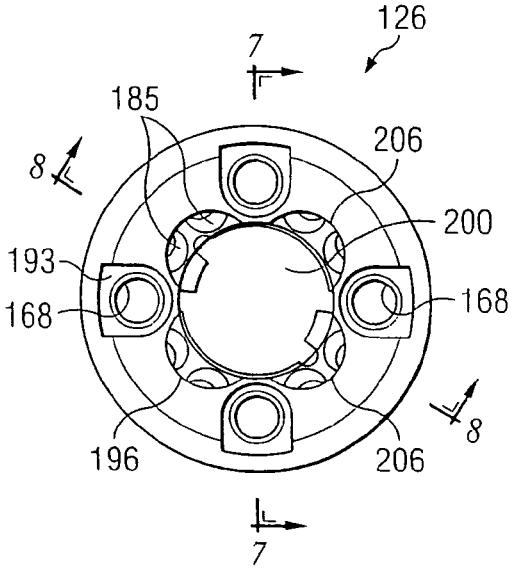
FIG. 9 is an end view of the tail cap of FIG. 6.

In the embodiment illustrated in FIGS. 8 and 9, two of exhaust ports 182 open into one of a plurality of semi cylindrical cutouts 206 formed in the inner wall 204. Cut outs 204 serve to increase the size and cross sectional area of annular space 202 thereby the area through which air is exhausted from tool 100, which in turn reduces back pressure increasing the efficiency of the tool.

Figure 6:
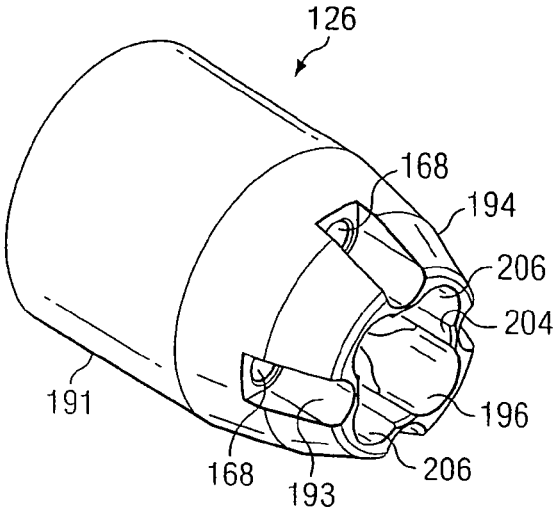
FIG. 6 is a perspective view of the end or tail cap of the ground piercing tool of FIG. 1.

The configuration of tail cap 126 provides a number of advantages when tool 100 is operated in the reverse mode. The position of rear openings 185 of exhaust ports 182 inside annular space 202 protects the ports 182 from being plugged with dirt and debris as the tool moves in the reverse direction. Semi cylindrical cut outs 206 permit exhaust ports 182 to open in annular space 202 by providing sufficient area for the passage of exhaust air through annular opening 202 without excessive back pressure. The cone shaped geometry of end section 194 tends to push debris to the sides of tool 100 rather than compacting debris in front of the rear end of the tool as the tool moves in the reverse direction. Additionally, as best shown in FIG. 6, a series of exterior cutouts 193 are formed in conical end section 194 for receiving bolts 128 so that the ends of bolts 128 do not protrude beyond the cone shaped exterior surface of end section 194.

It will be understood that the foregoing description is of preferred exemplary embodiments of the invention, and that the invention is not limited to the specific forms shown. For example, the cut outs formed in the rearwardly opening recess of the tail cap could have a geometry other than semi cylindrical. These and other modifications may be made without departing from the scope of the invention as expressed in the appended claims.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

The invention claimed is:

1. A pneumatic ground piercing tool, comprising:

an elongated hollow body having a front nose and a rear opening;

a striker disposed for reciprocation within an internal chamber of the body to impart impacts thereto for driving the body through the ground;

a stepped air inlet conduit which cooperates with the striker within the internal chamber of the body to reciprocate the striker and impart blows to a front end wall of the internal chamber under the action of a pressure fluid fed into the rear recess in the striker;

a tail assembly mounted in the rear opening of the body having exhaust passages therethrough, at least a potion of each exhaust passage angling radially inwardly to communicate with a central hole at the rear end of the tail assembly whereby exhaust escapes through the central hole, the tail assembly including a tail nut threadedly secured to the body inside the rear opening thereof and having a plurality of threaded, rearwardly opening holes therein, an end cap disposed to fit over the rear opening of the body, the end cap having openings therein in alignment with the threaded holes in the tail nut and forming the central hole through which the air inlet conduit passes; and a plurality of bolts which extend through the openings and are threadedly secured in the threaded holes in the tail nut so that the end cap is securely clamped to the tool body and an axial clamp load is applied to the tail nut.

2. The pneumatic ground piercing tool of claim 1 further comprising a resilient isolator clamped between the tail nut and the air inlet conduit.

3. The pneumatic ground piercing tool of claim 2 wherein the isolator is formed with a series of lands and grooves to prevent lengthwise movement of the air inlet conduit.

4. The pneumatic ground piercing tool of claim 1 wherein the tail nut further comprises exterior threads formed on a forward portion thereof, the exterior threads engaging interior threads formed on the inner surface of the body adjacent the rear opening thereof.

5. The pneumatic ground piercing tool of claim 1 wherein said tail nut further comprises a plurality of exhaust passages arranged in a circular pattern around the central hole.

6. The pneumatic ground piercing tool of claim 5 wherein the threaded, rearwardly opening holes are disposed between the exhaust passages.

7. The pneumatic ground piercing tool of claim 6, wherein the tail cap comprises a plurality of exhaust ports, the exhaust ports extending between the tail nut and the central hole whereby exhaust escapes through the central hole.

8. The pneumatic ground piercing tool of claim 5 wherein the exhaust ports extend radially inwardly in a front to rear direction along at least a portion of the length of the end cap to communicate with the central hole.

9. The pneumatic ground piercing tool of claim 1 further comprising a mechanism that reverses the direction of travel of the tool by causing the striker to impact against the tail assembly instead of the front end wall of the internal chamber of the body.

10. A pneumatic ground piercing tool, comprising:

an elongated hollow body having a front nose and a rear opening;

a striker disposed for reciprocation within an internal chamber of the body to impart impacts thereto for driving the body through the ground, the striker having a rearwardly opening recess and a rear radial passage through a wall enclosing the recess, a front portion having a front bearing thereon for sliding contact with a first inner surface of the body and passages permitting flow of pressure fluid to a front, variable-volume pressure chamber ahead of the striker, and a rear portion having a rear bearing thereon rearwardly of the radial passage for sliding contact with a second inner surface the body;

a stepped air inlet conduit which cooperates with the striker within the internal chamber of the body to reciprocate the striker and impart blows to a front end wall of the internal chamber under the action of a pressure fluid fed into the rear recess in the striker, followed by reverse movement of the striker when the rear radial passage moves past a front edge of the step of the stepped air inlet conduit, and exhaust of compressed air when the rear radial passage moves past a rear edge of the step of the stepped air inlet conduit; and a tail assembly mounted in the rear opening of the body that secures the air inlet conduit in the body, wherein the tail assembly has exhaust passages therethrough, at least a potion of each exhaust passage angling radially inwardly to communicate with a central hole at the rear end of the tail assembly, whereby exhaust escapes through the central hole.

11. The pneumatic ground piercing tool of claim 10, wherein the angled portion of each exhaust passage extends at an angle of from 10 to 20 degrees relative to a lengthwise axis of the tool.

12. The pneumatic ground piercing tool of claim 10, wherein the tail assembly comprises:

a tail nut threadedly secured to the body inside the rear opening thereof and having a central opening through which the air inlet conduit extends and a plurality of threaded, rearwardly opening holes therein; and an end cap disposed to fit over the rear opening of the body, the end cap having openings therein in alignment with the threaded holes in the tail nut and forming the central hole through which the air inlet conduit passes.

13. The pneumatic ground piercing tool of claim 12 further comprising a plurality of bolts extending through the openings and secured in the threaded holes in the tail nut so that the end cap is securely clamped to the tool body and an axial clamp load is applied to the tail nut; and wherein exhaust passages extending through the tail nut and end cap are angled radially inwardly along a portion of the length thereof to communicate with the central hole in the end cap, whereby exhaust escapes through the central hole about the outside of air inlet conduit.

14. The tool of claim 13, wherein portions of the exhaust passages extending through the end cap extend at an angle radially inwardly in a front to rear direction to communicate with the central hole.

15. The tool of claim 14, wherein portions of the exhaust passages extending through the tail nut extend in parallel to a lengthwise axis of the tool.

16. The tool of claim 14, wherein the exhaust passages end in outlet holes in an end wall of a rearwardly opening recess in the end cap, and the end cap has a rearwardly tapering, conical rear end portion that at least partially overlies the outlet holes but is spaced therefrom.

17. The tool of claim 16, wherein the conical rear end portion has a series of cutouts in its outer periphery thereof to permit access to the openings in the end cap from outside of the end cap.

* * * * *